US007749021B2

(12) United States Patent
Brodeur

(10) Patent No.: US 7,749,021 B2
(45) Date of Patent: Jul. 6, 2010

(54) SEGMENTED ANNULAR GLAND CHUCK FOR TERMINATING AN ELECTRICAL CABLE

(75) Inventor: Marc Brodeur, St-Jean-sur-Richelieu (CA)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/388,964

(22) Filed: Feb. 19, 2009

(65) Prior Publication Data

US 2009/0221177 A1 Sep. 3, 2009

Related U.S. Application Data

(60) Provisional application No. 61/032,168, filed on Feb. 28, 2008.

(51) Int. Cl.
*H01R 9/05* (2006.01)

(52) U.S. Cl. ..... 439/578; 174/359

(58) Field of Classification Search ..... 439/578; 174/359

See application file for complete search history.

(56) References Cited

U.S. PATENT DOCUMENTS 4,030,741 A 6/1977 Fidrych
4,209,661 A 6/1980 Pate et al.
4,273,405 A 6/1981 Law
5,051,541 A 9/1991 Bawa et al.
5,059,747 A 10/1991 Bawa et al.
5,208,427 A 5/1993 Couto et al.
5,405,172 A 4/1995 Mullen, Jr.
5,951,327 A 9/1999 Marik
6,639,146 B1 * 10/2003 Chiu ..... 174/359
6,796,586 B2 9/2004 Werth
7,156,671 B2 * 1/2007 Kauth ..... 439/98
7,300,309 B2 * 11/2007 Montena ..... 439/578
2006/0141829 A1 * 6/2006 Kauth ..... 439/98
2006/0223367 A1 * 10/2006 Montena ..... 439/578

* cited by examiner

*Primary Examiner*—Truc T Nguyen
(74) *Attorney, Agent, or Firm*—Hoffmann & Baron, LLP

(57) ABSTRACT

The invention provides a connector for terminating an electrical cable, including: a connector body having a receiving and an egressing end, axially bored therethrough; a compression nut attachable to the cable egressing end; and an annular segmented gland chuck for engagement with the cable for securing the cable within the body; the segmented chuck including an annular base and a plurality of circumferentially spaced chuck segments extending from the base, each the chuck segment being axially deflectable about a base hinge perpendicular to the axis and circumferentially deflectable towards the axis about a segmented hinge parallel to the axis.

16 Claims, 5 Drawing Sheets

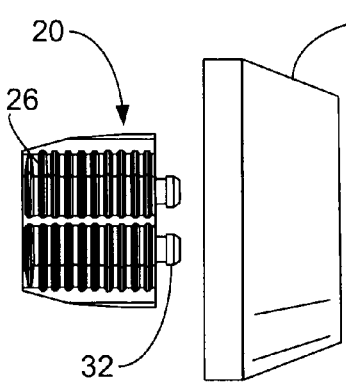
FIG. 4A
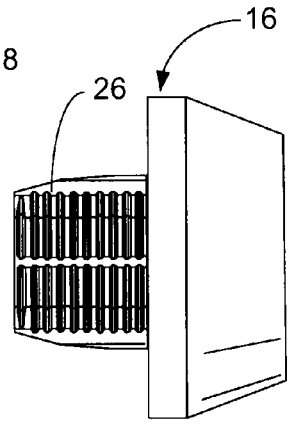
FIG. 4B
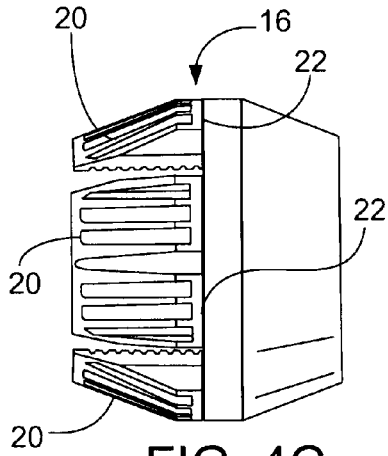
FIG. 4C
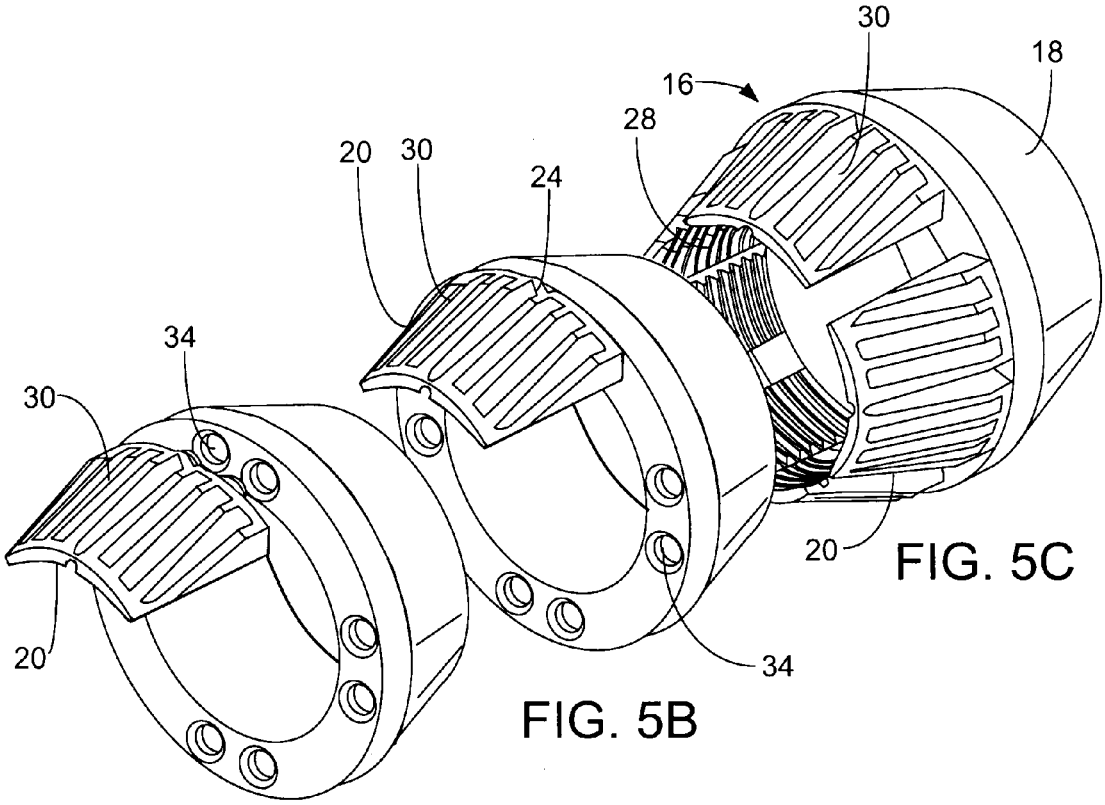
FIG. 5C
FIG. 5B
FIG. 5A

SEGMENTED ANNULAR GLAND CHUCK FOR TERMINATING AN ELECTRICAL CABLE

CROSS-REFERENCE TO RELATED APPLICATIONS

This application claims priority to U.S. Provisional Patent Application No. 61/032,168 filed on Feb. 28, 2008, the contents of which are incorporated herein by reference in entirety.

FIELD OF THE INVENTION

The invention relates to a connector for terminating an electrical cable. More particularly, the invention relates to an annular segmented gland chuck for engaging and securing a cable.

BACKGROUND OF THE INVENTION

Wedged bushing and chuck systems are used in connectors as a means of restraining and securing cables in the connectors. The chuck is a solid rigid device which tangentially engages the cable, where the chuck compresses about the cable jacket in order to prevent it from slipping or dislodging from the connector. Upon tightening of the connector, often times the chuck permanently damages the cable jacket and may also compromise the conductor within. Further, as the chuck is rigid, many chuck sizes must be purchased and stocked in order to suit a wide range of cable diameters.

Thus, there exists a need in the art to secure and retain a range of cables at an electrical termination site efficiently and effectively while preventing damage to the cable jacket and conductor within.

SUMMARY OF THE INVENTION

A first aspect of the invention provides a connector for terminating an electrical cable. The connector includes: a connector body having a cable receiving end and an opposed cable egressing end and an axial bore extending therethrough; a compression nut attachable to the cable egressing end; and an annular segmented gland chuck for engagement with the cable for securing the cable within the body upon attachment of the compression nut to the connector body. The segmented chuck includes an annular base and a plurality of circumferentially spaced chuck segments extending from the base, each the chuck segment being axially deflectable about a base hinge which is perpendicular to the axis and being circumferentially deflectable towards the axis about a segmented hinge parallel to the axis.

A second aspect of the invention provides a connector for terminating an electrical cable. The connector includes: a connector body having a cable receiving end and an opposed cable egressing end and an axial bore extending therethrough; a compression nut attachable to the cable egressing end; and an annular segmented gland chuck for engagement with the cable for securing the cable within the body upon attachment of the compression nut to the conduit body. The segmented chuck includes an annular base having a plurality of circumferentially spaced chuck segments extending from the base, each of the chuck segment removably attached about the annular base to accommodate different-sized cables.

These and other features of the invention will be better understood through a study of the following descriptive and accompanying drawings.

BRIEF DESCRIPTION OF THE DRAWINGS

FIG. 4A-C are various plan side-views showing, from left to right, the annular base with an aligned (not anchored) chuck segment; the annular base with an anchored chuck segment; and the segmented gland chuck, fully constructed; and FIG. 5A-C perspective views showing, from left to right, the annular base with an aligned (not anchored) chuck segment; the annular base with an anchored chuck segment; and the segmented gland chuck, fully constructed.

DETAILED DESCRIPTION OF THE INVENTION

The present invention provides a connector for terminating electrical cables. Typically, long cables or conduit carrying conductors must be terminated at various sites, including for example, conduit boxes and junction boxes. Connectors are compressed around an end of the cable or conduit to terminate it to a box.

The present invention provides a connector which accommodates a range of cables and provides strain relief, preventing the cable from slipping or pulling out the box while maintaining the cord structural integrity and preventing damage thereto. Further, the present invention is configured to accommodate, secure, and retain a large range of cable diameter sizes with a single electrical connector fitting.

Figure 1A:
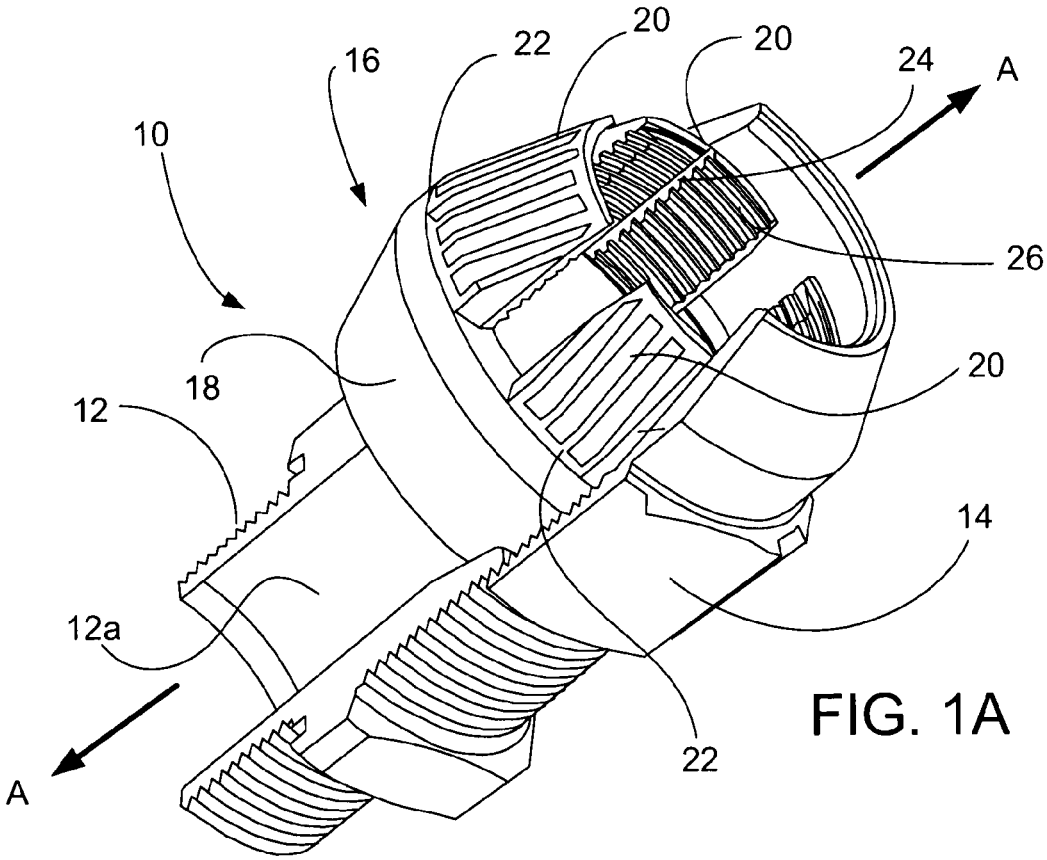
FIG. 1A-B are two perspective views of a partial cut-away view of the connector body and compression nut, showing the segmented gland chuck within.
Figure 1B:
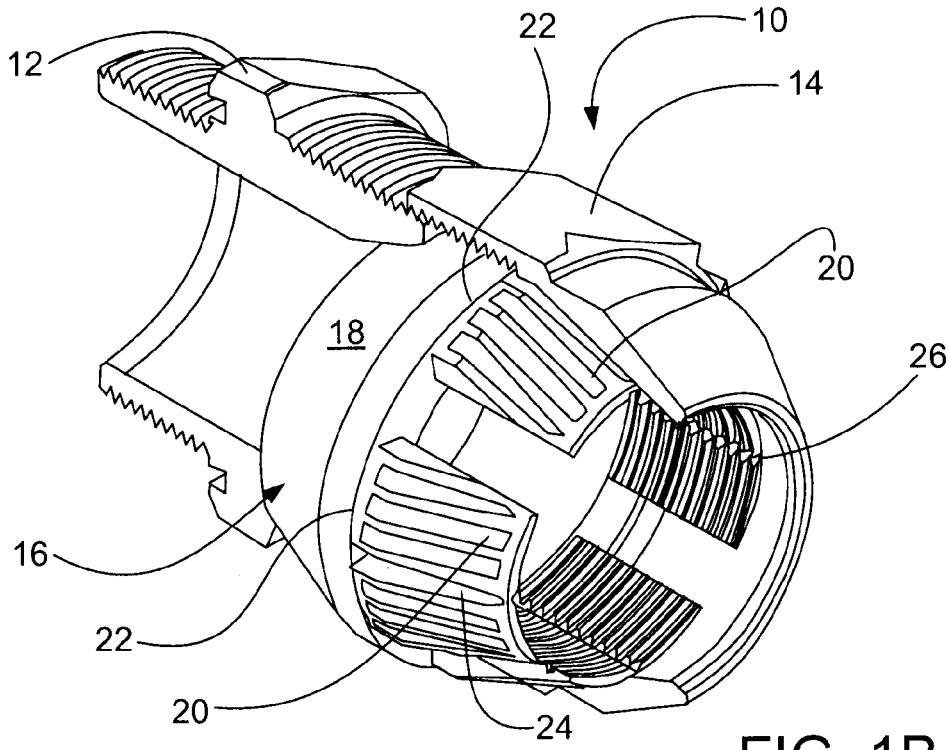
Figure 2A:
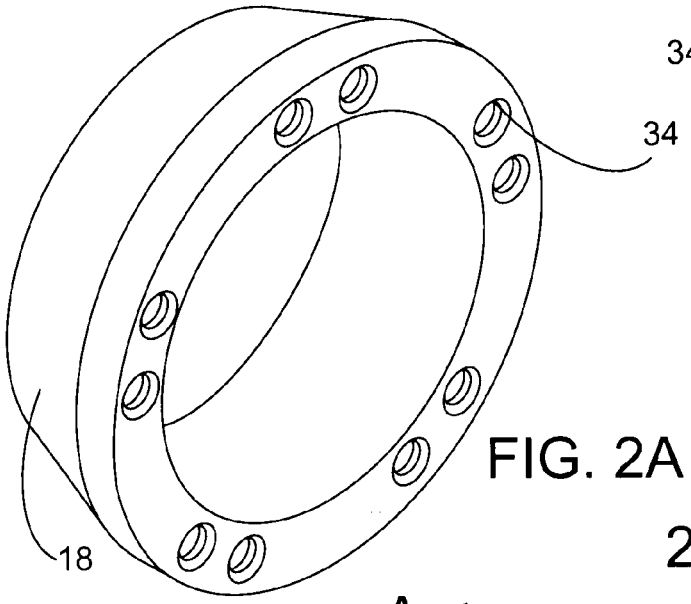
FIG. 2A-E are various views of the annular base and anchor portion of the annular base of the connector of the present invention.
Figure 2D:
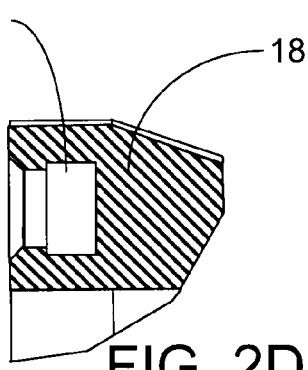
Figure 2B:
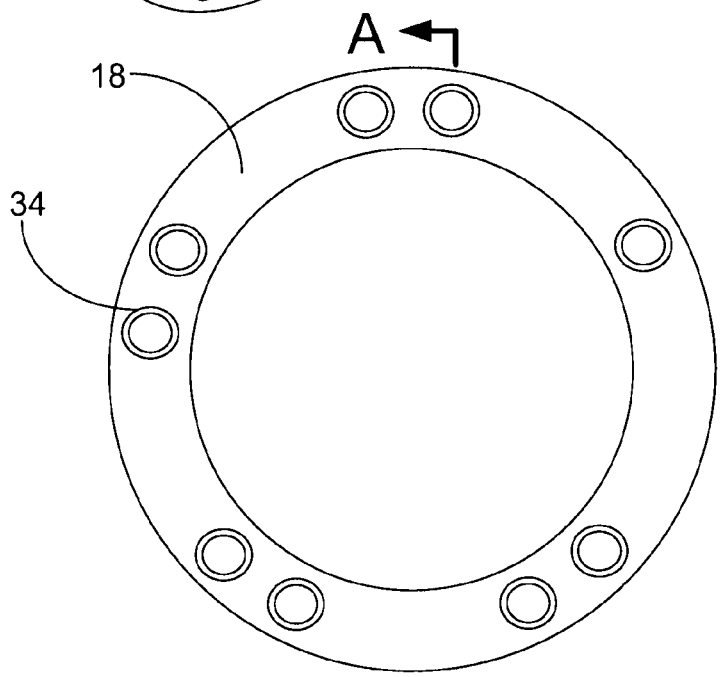
Figure 2C:
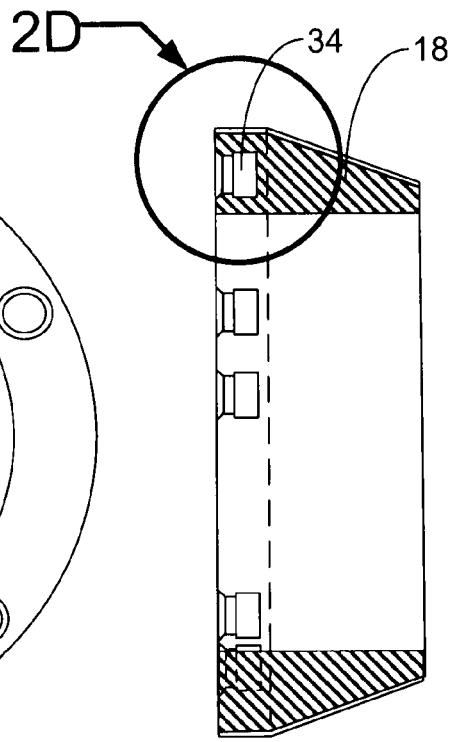
Figure 2E:
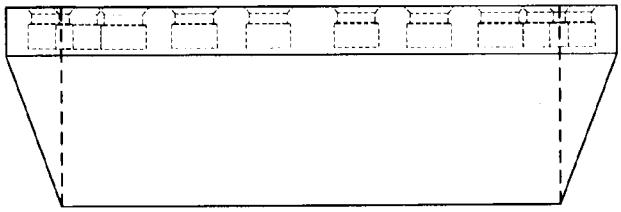
Figure 3A:
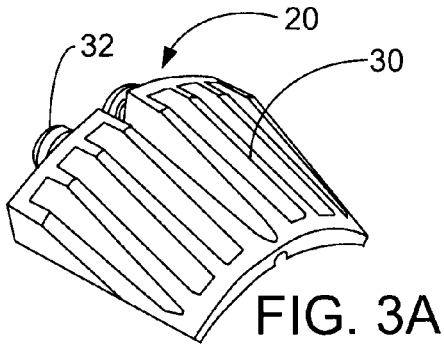
FIG. 3A-N are various perspective views of the chuck segment of the connector of the present invention.
Figure 3B:
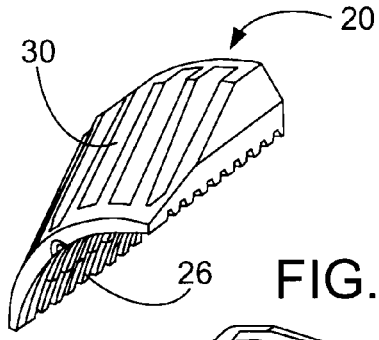
Figure 3C:
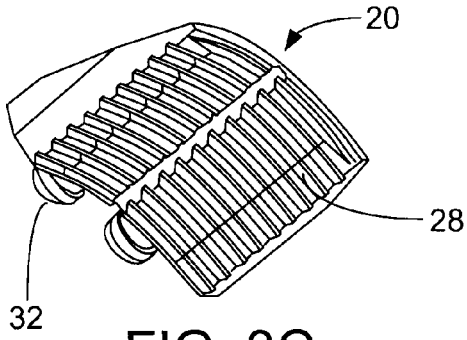
Figure 3D:
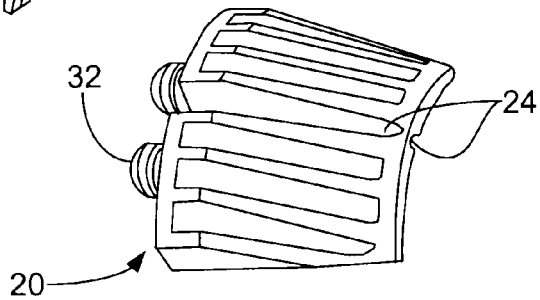
Figure 3F:
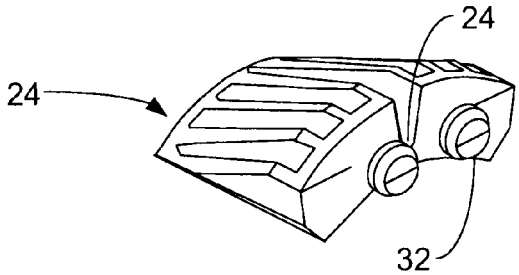
Figure 3E:
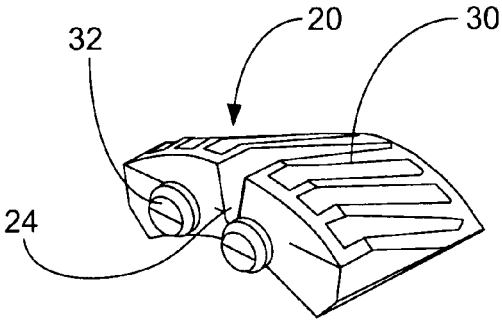
Figure 3G:
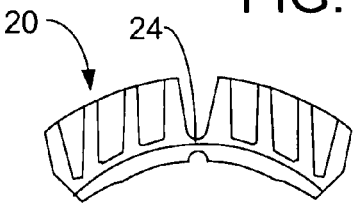
Figure 3H:
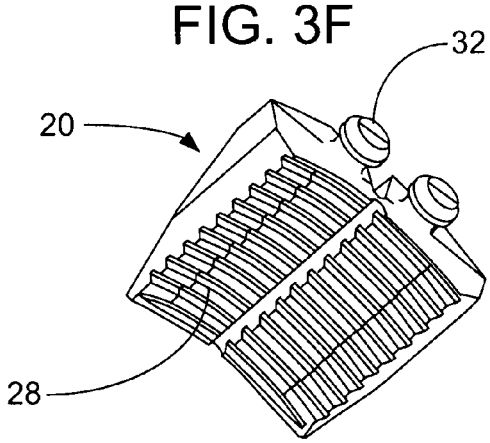
Figure 3J:
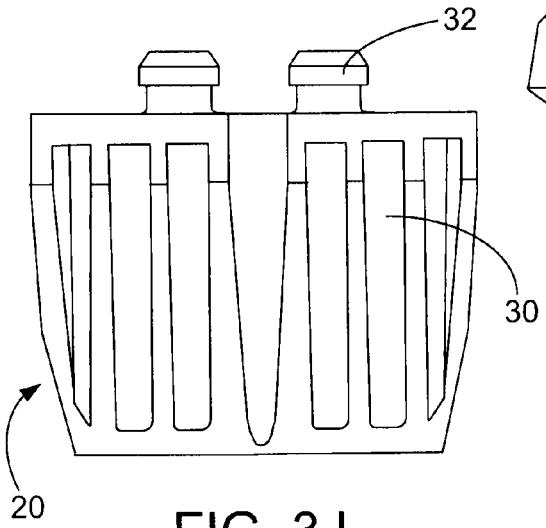
Figure 3I:
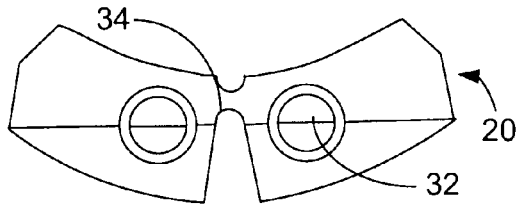
Figure 3K:
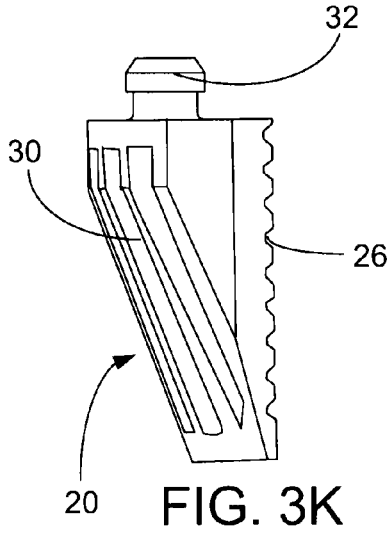
Figure 3L:
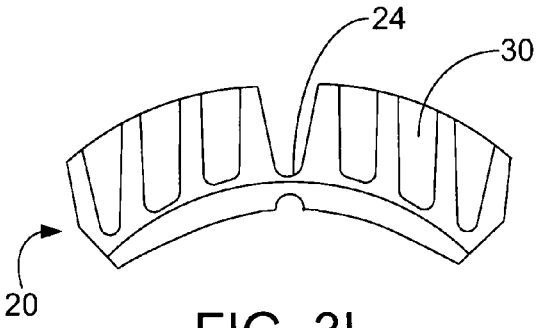
Figure 3M:
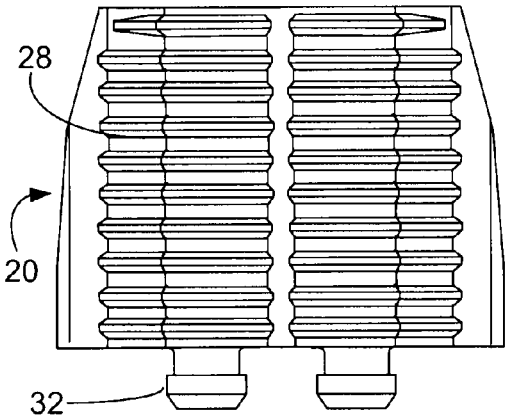
Figure 3N:
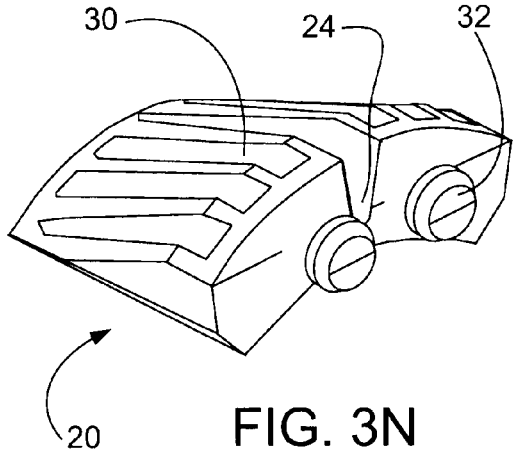

FIGS. 1A and 1B depict a connector 10 for terminating an electrical cable of the present invention. The connector 10 includes a connector body 12, a compression nut 14, and an annular segmented gland chuck 16. The connector body 12 has a cable receiving end and an opposed cable egressing end and an axial bore 12*a* extending therethrough. The compression nut 14 is attachable to the cable egressing end by threaded screw attachment. The annular segmented gland chuck 16 is located at the junction of the body 12 and the compression nut 14 and is configured to engage with the cable (not shown) in order to secure the cable within the body 12 upon attachment of the compression nut 14 to the connector body 12. Gland chuck 16 is preferably separately constructed as shown but it may also have components formed in conjunction with connector body 12.

The segmented gland chuck 16 includes base 18 and a plurality of removable circumferentially spaced chuck segments 20 extending from the base 18. Base 18 may be composed of one or more materials such that the base 18 is pliable or otherwise elastomerically deformable with respect to the body 12 and around the cable. For example, the base 18 may be composed of polymer, plastic, or rubber. As such, the base 18 may cooperate with the body 12 and the compression nut 14 to create and maintain a tight environmental seal and restraining grip around the cable. Base 18 is shown as being a separate unitary annular ring but base 18 may itself be segmented or base 18 may comprise part of connector body 12.

Each of the chuck segments 20 extending from the annular base 18 is deflectable about a base hinge 22. The base hinge 22 allows movement about an axis that is generally perpendicular to the axis A of the bore. In such a fashion, the chuck segment 20 is circumferentially deflectable towards the axial bore 12*a* to engage the cable. Also, each of the chuck segments 20 also has a segmented hinge 24 that allows movement of chuck segments 20 about an axis parallel to the axis A. As such, the chuck segment 20 is also longitudinally deflectable along the cable towards axial bore 12*a*.

The chuck segment 20 may optionally include a first uneven face 26 on its innermost surface. The first uneven face 26 is configured to frictionally engage a portion of the cable upon tightening the connector 10. The first uneven face 26 may be of any configuration which may promote frictional engagement of the cord and/or maximizing the surface area over which the compressive force is applied to the cord. For example, the first uneven face 26 may be, a raised ridge and valley configuration 28, as is shown in the figures, a raised rib pattern (not shown), a raised waffle pattern (not shown), or the like.

The chuck segment 20 optionally has a second uneven face 30 on the exterior thereof. The second uneven face 30 is configured to frictionally engage a portion of the compression nut 14 upon tightening of the connector 10. The second uneven face 30 may be of one or more patterns, including a raised-ribbed configuration, as is shown in the Figures. Optionally, the chuck segment 20 may be pliable in order to encourage chuck segment deformation about the hinges (22, 24) in order to pivot about two separate axes so as to engage the cable.

Further still, the connector 10 includes a removably attachable chuck segments 20, which removably hingeably attach to the annular base 18. Thus, the chuck segment 20 includes an anchor 32 and the annular base 18 includes a corresponding retaining hole 34. The anchor 32 and the hole 34 provides a cooperative detent to lock, and securely retain the chuck segment 20 to the annular base 18. As such, the annular base 18 of the connector 10 may include a plurality of corresponding retaining holes 34 to allow a user to attach a plurality of the chuck segments 20 via respective anchors 32. Each chuck segment 20 may have one or more anchors 32, as is shown in the Figures. This modular conformation of the present invention allows for few or many chuck segments 20 to be employed on the annular base 18 such that cables of various sizes can be secured and retained by the connector 10.

Optionally, the segmented gland chuck of the present invention may have chuck segments 20 with dual hinges (22, 24), removably attachable chuck segments 20 via chuck segment anchors 32 and corresponding annular base retaining holes 34, or a combination thereof.

The various embodiments of the present invention enable the electrical connector to apply radial retention pressure on the cable about two different axes of movement. As shown in the Figures, the chuck segments 20 employed in the electrical connector 10 may be hinged (22, 24) such that the chuck segments 20 pivot and wrap around the cable to maximize the surface area of contact between the chuck segments 20 and the cable. Additionally, as shown in the figures, the chuck segments may be of a wedge shape in order further maximize the chuck segment 20 contact surface area to the cable.

The various elements and features of the present invention allows for connector 10 to retain the cable while spreading out the compressive force along the surface of the chuck segments 20 in order to prevent damage to the cable jacket and conductor of the cable. Thus, the chuck segment 20 is configured to pivot inwardly radially about hinge 22 so as to engage the cord, and also pivot or fold longitudinally along the cord about hinge 24 so as to wrap around the cord. This arrangement now makes it possible to accommodate a larger variety of cords.

The uneven face 26 of the chuck segment 20 offers advantageous restriction against cable pull-out from the termination site by distributing the compression pressure among many hills and valleys of the surface instead of creating a big dent or dig in the cable which may tear the jacket or otherwise damage the conductor within.

Also, the present invention may be configured to employ a modular design with removably attachable chuck segments 20. Various numbers of chuck segments 20 may be attached to the annular base 18 of the segmented gland chuck 16 in order to configure to cables of varying diameters. Thus, the modular design allows for a single annular base 18 and preferably a multitude of chuck segments 20 that are sized and dimensioned to be employed in fitting a wide range of cables for a single fitting. That is, identical segments may be added or removed in order to accommodate cables of different sizes. For example, a user may install three, four, or five chuck segments 20, as needed, to create a proper fit for a large range of cables. The electrical connector 10 of the present invention eliminates the need to purchase and store various-sized electrical connectors and components thereof.

With the modular concept, the electrical connector embodiments of the present invention may in turn have an increased safety fitting for use with tray cable and portable cord. The modular concept also minimizes the tooling investment by reducing the number of different sized chucks that must be purchased and stocked.

A number of embodiments of the invention have been described. Nevertheless, it will be understood that various modifications may be made without departing from the spirit and scope of the invention. Also, the features and elements described above may be modified in various than described above, where appropriate. Accordingly, alternative embodiments are within the scope of the following claims.

What is claimed:

1. A connector for terminating an electrical cable, said connector comprising:

a connector body having a cable receiving end and an opposed cable egressing end and an axial bore extending therethrough;

a compression nut attachable to said cable egressing end; and an annular segmented gland chuck for engagement with said cable for securing said cable within said body upon rotation of said compression nut to said connector body;

said segmented gland chuck including a plurality of chuck segments circumferentially spaced about the cable egressing end, each said chuck segment being deflectable about a base axis which is perpendicular to said axial bore and being deflectable about a longitudinal axis which is parallel to said axial bore, wherein said chuck segments are removably attachable to a base of said gland chuck.

2. The connector of claim 1, wherein said segmented gland chuck also comprises a base to which said chuck segments are attached.

3. The connector of claim 1, wherein said chuck segment includes a first uneven face configured to frictionally engage a portion of said cable upon tightening said connector.

4. The connector of claim 1, further wherein a first uneven face comprises a raised ridged face.

5. The connector of claim 1, further wherein said chuck segment is pliable to pivot radially inwardly and longitudinally along said cable.

6. The connector of claim 1, further wherein said chuck segment includes an anchor and said gland chuck base includes a corresponding retaining hole, wherein said anchor and said retaining hole cooperate to retain and secure said chuck segment to said gland chuck.

7. The connector of claim 2, wherein said base is unitary and annular in shape.

8. The connector of claim 3, wherein said chuck segment includes a second uneven face configured to frictionally engage a portion of said compression nut upon tightening.

9. The connector of claim 2, further wherein said chuck segments are removably attachable to said base.

10. The connector of claim 9, further wherein said chuck segment includes an anchor and said base includes a corresponding retaining hole, wherein said anchor and said retaining hole cooperate to retain and secure said chuck segment to said base.

11. The connector of claim 9, further wherein said base includes a plurality of corresponding retaining holes to correspond to a plurality patterns of retained chuck segments for securing varying-sized cables.

12. A connector for terminating an electrical cable, said connector comprising:

a connector body having a cable receiving end and an opposed cable egressing end and an axial bore extending therethrough;

a compression nut attachable to said cable egressing end; and an annular segmented gland chuck for engagement with said cable for securing said cable within said body upon attachment of said compression nut to said conduit body;

said segmented chuck including an annular base having a plurality of circumferentially spaced chuck segments extending from said base, each of said chuck segment removably attached about said annular base to accommodate different diameters of said cable.

13. The connector of claim 12, further wherein the chuck segment is removably attachable by an anchor configured to fit and retain said chuck segment into a corresponding hole in said annular base.

14. The connector of claim 12, further comprising a base hinge which is perpendicular to said axis, such that said chuck segments are axially deflectable about a base hinge which is perpendicular to said axis.

15. The connector of claim 14, further wherein said chuck segment includes a segmented hinge parallel to said axis such that said chuck segment is circumferentially deflectable towards said axis.

16. A connector for terminating an electrical cable, said connector comprising:

a connector body having a cable receiving end and an opposed cable egressing end and an axial bore extending therethrough;

a compression nut attachable to said cable egressing end; and an annular segmented gland chuck for engagement with said cable for securing said cable within said body upon rotation of said compression nut to said connector body;

said segmented gland chuck including a plurality of chuck segments circumferentially spaced about the cable egressing end, each said chuck segment being deflectable about a base axis which is perpendicular to said axial bore and being deflectable about a longitudinal axis which is parallel to said axial bore, wherein said chuck segments are removably attachable to a base of said gland chuck; and said chuck segments include a first uneven face configured to frictionally engage a portion of said cable upon tightening said connector, and said chuck segments include a second uneven face configured to frictionally engage a portion of said compression nut upon tightening.

* * * * *